US005490697A

United States Patent [19]

Surko, Jr.

[11] Patent Number: 5,490,697

[45] Date of Patent: Feb. 13, 1996

[54] ACCESS CONTROL ASSEMBLY

[75] Inventor: Walter E. Surko, Jr., Southington, Conn.

[73] Assignee: International Security Products, Inc., Southington, Conn.

[21] Appl. No.: 226,682

[22] Filed: Apr. 12, 1994

[51] Int. Cl.[6] ..... E05B 65/10

[52] U.S. Cl. ..... 292/92; 292/DIG. 71; 292/DIG. 65; 292/DIG. 60; 292/341.18; 292/196

[58] Field of Search ..... 292/DIG. 65, DIG. 71, 292/242, 92, 196, DIG. 24, DIG. 37, DIG. 60, 332, 341.18, 340; 70/92

[56] References Cited

U.S. PATENT DOCUMENTS

| | | | |
|---|---|---|---|
| 876,348 | 1/1908 | Hall | 292/341.18 |
| 2,342,250 | 2/1944 | Burke | 292/332 |
| 2,469,113 | 5/1949 | Hooker | 292/232 |
| 2,636,767 | 4/1953 | Greoger | 292/341.18 |
| 2,752,773 | 7/1956 | Abelson et al. | 292/92 |
| 2,893,772 | 7/1959 | Edwards | 292/92 |
| 3,652,113 | 3/1972 | Odend'hal et al. | 292/DIG. 71 |
| 3,877,262 | 4/1975 | Williams | 292/92 |
| 4,203,622 | 5/1980 | Cook et al. | 292/DIG. 71 |
| 4,280,725 | 7/1981 | Berkowitz et al. | 292/DIG. 71 |
| 4,635,977 | 1/1987 | Yamada | 292/DIG. 71 |

*Primary Examiner*—Darnell M. Boucher
*Attorney, Agent, or Firm*—Chilton, Alix & Van Kirk

[57] ABSTRACT

A locking device, suitable for walk-in freezer doors, automatically locks when the door is closed, allows the door to be pulled open from the outside only when a proper key is inserted and rotated 90°, and always allows the door to be opened from the inside by pushing on a manual actuator. The locking device includes a strike mounted on the door frame, an outside plate assembly including a rigid handle and lock cylinder, and an inside plate assembly including a bracket supporting a spring loaded bolt, an enabling mechanism in the form of a collapsible linkage coupled to the bolt, a manual actuator, and a cover.

20 Claims, 7 Drawing Sheets

ACCESS CONTROL ASSEMBLY

BACKGROUND OF THE INVENTION

This invention relates generally to controlling access to enclosures and particularly to security devices for insulated doors. More specifically, the present invention is directed to lock assemblies which are suitable for use on access doors of walk-in storage compartments such as refrigerators and freezers of the type used in the commercial preparation of food. Accordingly, the general objects of the present invention are to provide novel and improved methods and apparatus of such character.

While not limited thereto in its utility, the present invention is particularly well suited for use on the insulated doors of walk-in refrigeration apparatus of the type employed in the restaurant industry. Commercial walk-in freezers and refrigerators commonly contain meat and other food products that are subject to damage if not properly refrigerated. Therefore, such refrigeration apparatti must have a latch mechanism which will ensure that their access doors securely latch when closed. Additionally, products such as meat and fish are valuable commodities and thus subject to theft. The doors of commercial walk-in freezers, accordingly, will desirably have a locking mechanism to prevent unauthorized entry. Optimally, such locking mechanisms will automatically lock the door each time it is closed. Further, safety considerations dictate that a lock for the door of a walk-in freezer or the like be operable from the inside of the freezer without a key to insure that personnel can not be accidently or deliberately locked in the refrigeration compartment.

Currently available freezer door lock assemblies are configured to be mounted on the outside surface of the door and, although generally available with some form of safety release from the inside, are not self locking. The outside mounting also exposes the strike, latch and handle to tampering and defeat of the lock assembly. The currently available lock assemblies generally rely on the use of a padlock for locking. Even those units with a built in lock cylinder have padlock provisions which demonstrates their design inadequacy.

The preferred configuration for any door locking device is to locate the latch or bolt and its related mechanism within the door or on the inside door surface to prevent or resist defeat from the outside. The only exposed components should be limited to those which are necessary for appropriate operation.

Because the doors of walk-in freezers are typically a sandwich construction, comprising a layer of foam between layers of relatively thin sheet metal, the door structure would be insufficient to provide adequate support for a lock installation within the door. Further, any significant displacement of the insulating foam would affect the insulating and structural properties of the door.

Mounting a locking device on the inside surface of the freezer door has, until now, been avoided because of the risk of frost and ice build up which would prevent proper Operation and cause a lock-in or lock-out.

SUMMARY OF THE INVENTION

The present invention overcomes the above briefly-discussed and other deficiencies and disadvantages of the prior art and, in so doing, provides a novel lock assembly which performs the functions of latching and locking doors and particularly doors of walk-in refrigeration apparatus or the like.

A lock assembly in accordance with the present invention comprises a strike mounted on the door frame, an outside plate assembly including a rigid handle and lock cylinder, and an inside plate assembly including a bracket supporting a spring loaded bolt, an enabling mechanism coupled to the bolt, a manual actuator, and a cover. The bolt enabling mechanism in accordance with the invention includes a collapsible linkage. In a preferred embodiment, this linkage is spring loaded and comprises three pair of serially connected, pivot arms. The bolt is pivotally supported from this linkage. Slight repositioning of the pivot arms, resulting from rotating the lock cylinder key or operating the manual actuator, converts the enabling linkage from a rigid or fixed support to a collapsible support. The important distinction between the present invention and similarly configured prior art locking devices is that, rather than using the key or manual operator to retract the bolt prior to pulling or pushing the door open, the pivot arms of the enabling linkage configure the latch mechanism for collapse, whereupon the bolt may retract, in response to turning the key or operating the manual actuator. Bolt retraction will occur when the door is pulled or pushed while the latch mechanism is in the enabled, i.e., the collapsible, state. During closing, contact between the back of the bolt and the strike, even when the bolt linkage is in the rigid stake, will cause the bolt to rotate and clear the strike.

It is, accordingly, an object of the present invention to provide a locking device, suitable for walk-in freezer doors, which automatically locks when the door is closed, which allows the door to be pulled open from the outside only when a proper key is inserted and rotated 90°, and which always allows the door to be opened from the inside by pushing on a manual actuator.

It is a further object of the present invention to provide a locking device, suitable for walk-in freezer doors or the like, which has no moving parts on the outside of the door except for the key plug of a cylinder lock, the present invention thus effectively resisting tampering from the outside of the door.

It is yet another object of the present invention to provide a locking device, suitable for use on the doors of walk-in refrigeration apparatus, which may be easily and quickly removed from the door for cleaning and which is not affected by frost or ice build-up.

It is also an object of the present invention to provide a locking device having mounting plates on the inside and outside of the door whereby the locking device may be incorporated as a rigid installation on a foam filled door.

It is still another object of the present invention to provide a locking device, suitable for use on walk-in freezer doors, which is configured to resist damage associated from impact from heavy food transporting carts.

A locking device in accordance with the present invention is further characterized by the ability to employ a standard rim cylinder, including lock cylinders of the type which have removable cores.

In accordance with an alternative form of the invention, a locking device in accordance therewith may be provided with a hold-back which enables the device to be set in the unlocked mode. The hold-back capability may be activated through the use of a key and will be located on the inside of the door.

BRIEF DESCRIPTION OF THE DRAWINGS

The present invention may be better understood and its numerous objects and advantages will become apparent to those skilled in the art by reference to the accompanying drawings, wherein like reference numerals refer to like elements in the several figures, and in which.

DETAILED DESCRIPTION OF THE DISCLOSED EMBODIMENT

Figure 1:
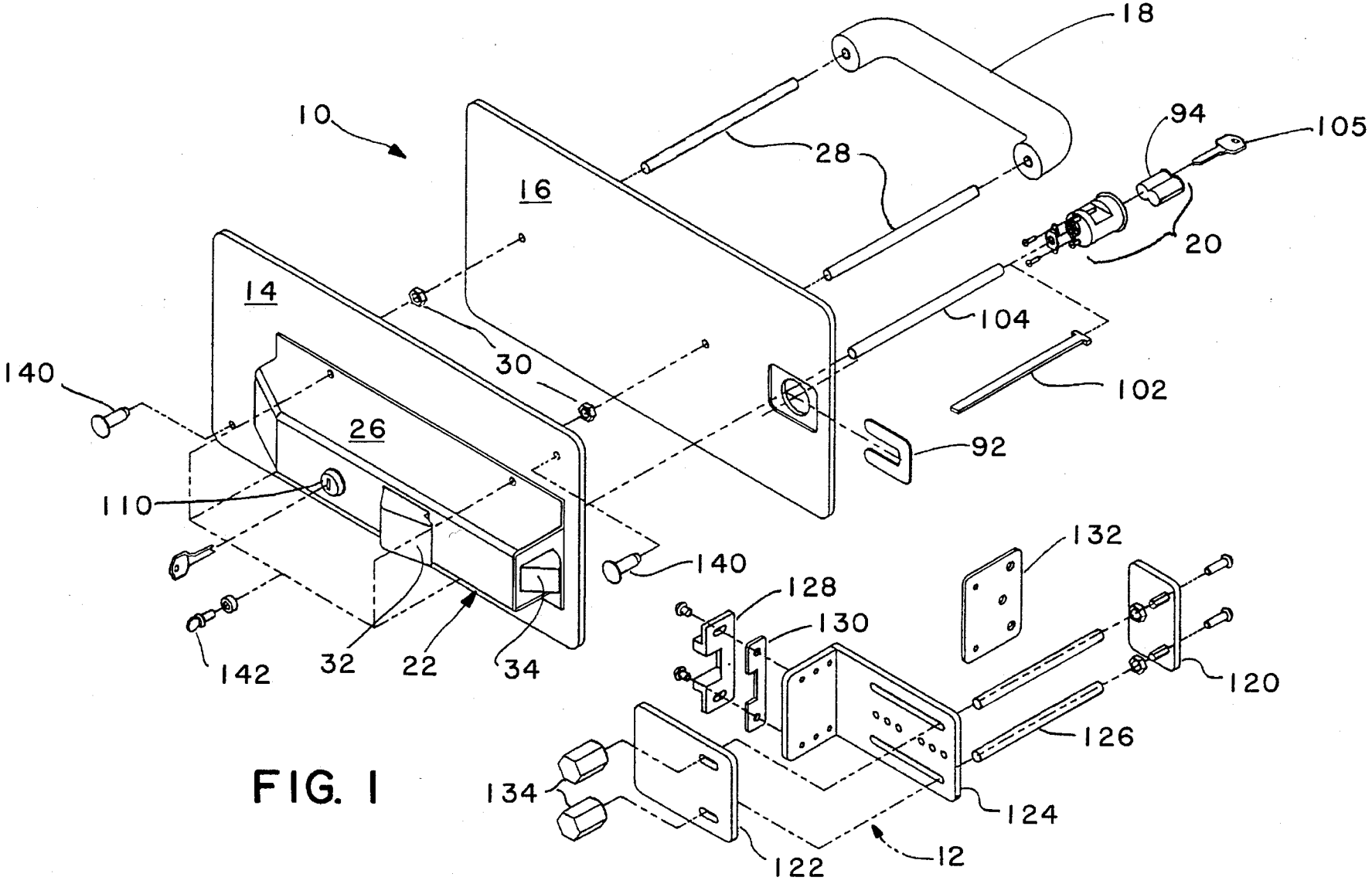
FIG. 1 is an exploded, perspective view of a lock assembly in accordance with the present invention.
Figure 2:
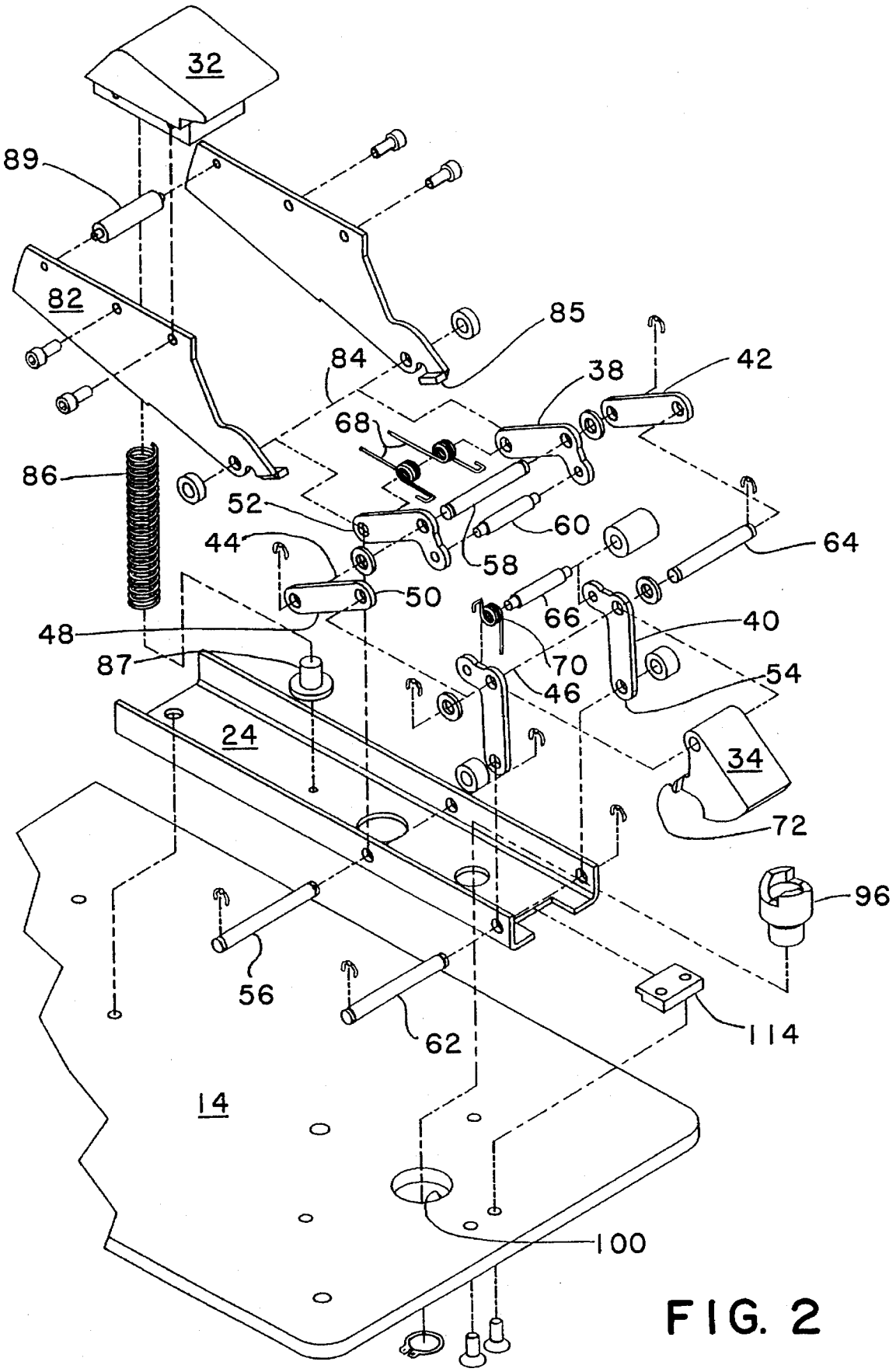
FIG. 2 is an enlarged, exploded, partial perspective view of the inside plate, bolt and operator subassembly of the lock assembly shown in FIG. 1, FIG. 2 being a view taken in a transverse direction when compared to FIG. 1.
Figure 3:
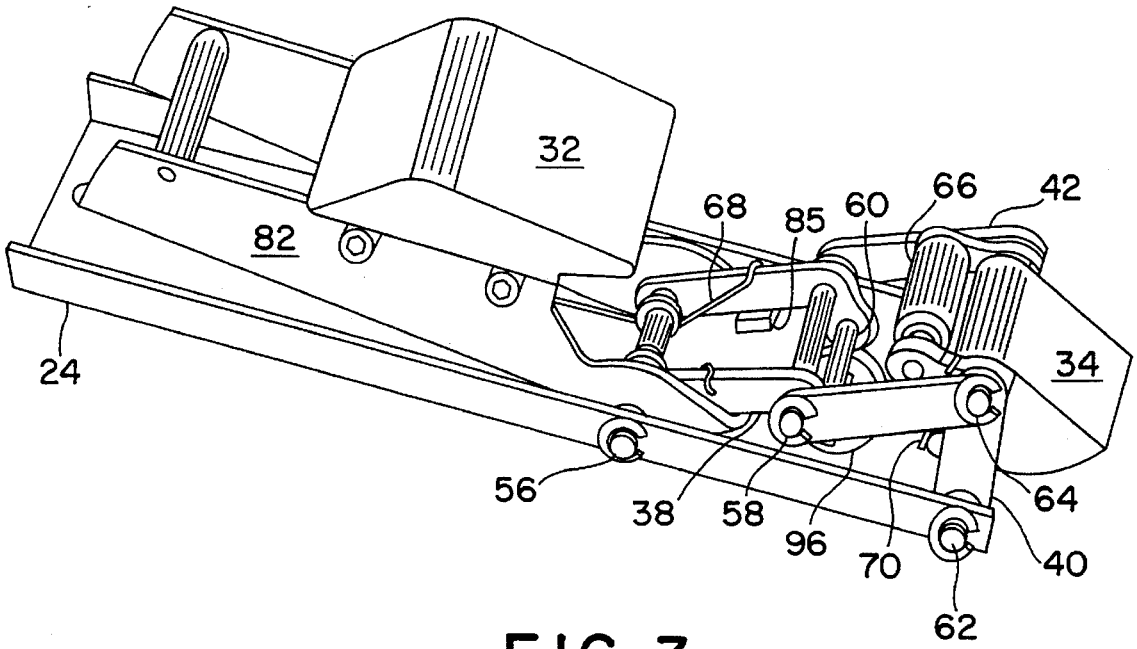
FIG. 3 is a perspective view of the operator subassembly of FIG. 2 in the assembled state, the inside plate being omitted from FIG. 2.

With reference to the drawings, a lock assembly in accordance with the present invention is generally designated by the numeral 10 in FIG. 1. Assembly 10 generally comprises an adjustable strike, indicated generally at 12 (see FIGS. 1 and 5–7), which will be mounted on the door frame. The door mounted components of assembly 10 include an inside plate 14, an outside plate 16, a handle 18, a key operated lock cylinder 20 and a bolt/operator subassembly. The bolt/operator subassembly is indicated generally at 22 and shown in an exploded view in FIG. 2. The bolt/operator subassembly, which will be described below, includes a support bracket 24, as shown in FIGS. 2 and 3, and is disposed within a cover 26. Both the bracket 24 and cover 26 are removably mounted on inside plate 14.

The key operated lock cylinder 20, which is a first means for controlling the enabling of the bolt for retraction, is received in an aperture 90 in outside plate 16 and is mounted to plate 16 by a retainer plate 92. In order to permit outside plate 16 to be flush-mounted on the door, a recess which receives retainer plate 92 is provided about aperture 90 on the side of outside plate 16 which faces the door. The lock 20 will preferably be of the type which has a plug 94 which may be removed through the use of a control key.

Continuing to refer to FIG. 1, the inside plate 14 and outside plate 16 are respectively positioned on the freezer door inside and outside surfaces (See also FIGS. 5–7). Studs 28, which threadably engage handle 18, extend through the outside plate 16, the door and the inside plate 14. Studs 28 are engaged by nuts 30 which integrate the handle with the outside plate. A second pair of nuts 30, not shown, engage studs 28 and the outwardly facing side of plate 14 and hold plate 14 against the door inside surface.

The operator subassembly comprises a manual actuator, in the form of a push pad 32, which extends through an opening in cover 26. Depression of pad 32, i.e., the application of force to pad 32 in the direction of the door, will result in a Pullman-type latch 34 being unblocked so that the bolt thereof may be cammed backwardly, i.e., into the cover 26, by strike 12 when opening force is applied to the door.

The strike 12 of the disclosed embodiment is an adjustable subassembly which is mounted on the door frame in a manner similar to the way in which the handle assembly is mounted to the door. Thus, the strike includes an outside plate 120, an inside plate 122 and a slidable strike support angle member 124. The plates 120 and 122 and the member 124 are interconnected by mounting rods 126 which extend through the door jamb. The actual strike member 128 is mechanically secured to member 124 and, if necessary, a spacer 130 may be disposed between strike 128 and its support member 124. In some cases it may also be desirable to employ a strike plate 132 which bridges the exposed portion of the door jamb between plate 120 and strike support member 124. As will be obvious, the position of strike 128 may be adjusted for proper operation of the lock assembly by simply loosening the mounting nuts 134 and sliding the strike support member 124 inwardly or outwardly as required.

Installation of a lock assembly in accordance with the invention on the door of a walk-in freezer or the like simply requires the drilling of holes through the door to accomodate the studs 28 and a tube 104 which receives the tailpiece 102 of lock cylinder 20. Once the lock assembly has been mounted to the door, and proper operation assured, the inside plate is used as a template to drill locating holes. Dowels 140 are subsequently inserted through inside plate 14 into these holes. The use of these locating holes and dowels prevent inside plate 14, and thus the operator subassembly, from shifting and facilitates the reinstallation of the lock and handle assembly if removal is required.

The push pad 32 is coupled to the bolt 34 by means of a collapsible enabling linkage defined by a pivot arm assembly. The pivot arm assembly includes three pairs of serially connected pivot arms 38, 40 and 42. In the following description of the disclosed embodiment, the term "pivot arm" will be used to refer to a pair of parallel pivot arms. Pivot arms 38 and 40 respectively have first pivot axes 44 and 46 located intermediate their ends. As will described in more detail below, the pivot axes 44 and 46 are movable. The first and second pivot arms 38, 40 each define a "dog leg" or offset, i.e., the pivot arms have two angularly related portions. The two portions of each pivot arm have axes which intersect at and are transverse to the pivot axes 44 and 46. In the disclosed embodiment, the arms 38 and 40 define right angle offsets, i.e., the angle of intersection of the arm portions is approximately 90°. The third pivot arm 42 is linear and has opposite first and second ends 48, 50. The third pivot arm first end 48 is coupled to pivot arm 38 so as to be rotatable about axis 44. The second end 50 of pivot arm 42 is coupled to pivot arm 40 so as to be rotatable about axis 46.

The first and second pivot arms 38, 40 are each pivotally supported at their oppositely disposed respective first ends 52 and 54 on the U-shaped bracket 24. The individual arms of each pivot arm pair are interconnected by plural axles. Thus, the pivot arm 38 has first, second and third axles 56, 58 and 60 while pivot arm 40 has axles 62, 64 and 66. The individual arms of the third pivot arm 42 are supported on and interconnected by the axles 60 and 64. As shown in FIGS. 2 and 3, right and left hand link springs 68 are mounted on axle 56 and have first ends engaged with the pivot arm 38 and second ends in contact with bracket 24.

The springs 68 bias the pivot arm 38 in a first direction which, as will be explained below, is commensurate with the disabled, i.e., locked, state of the operator subassembly.

Figure 4:
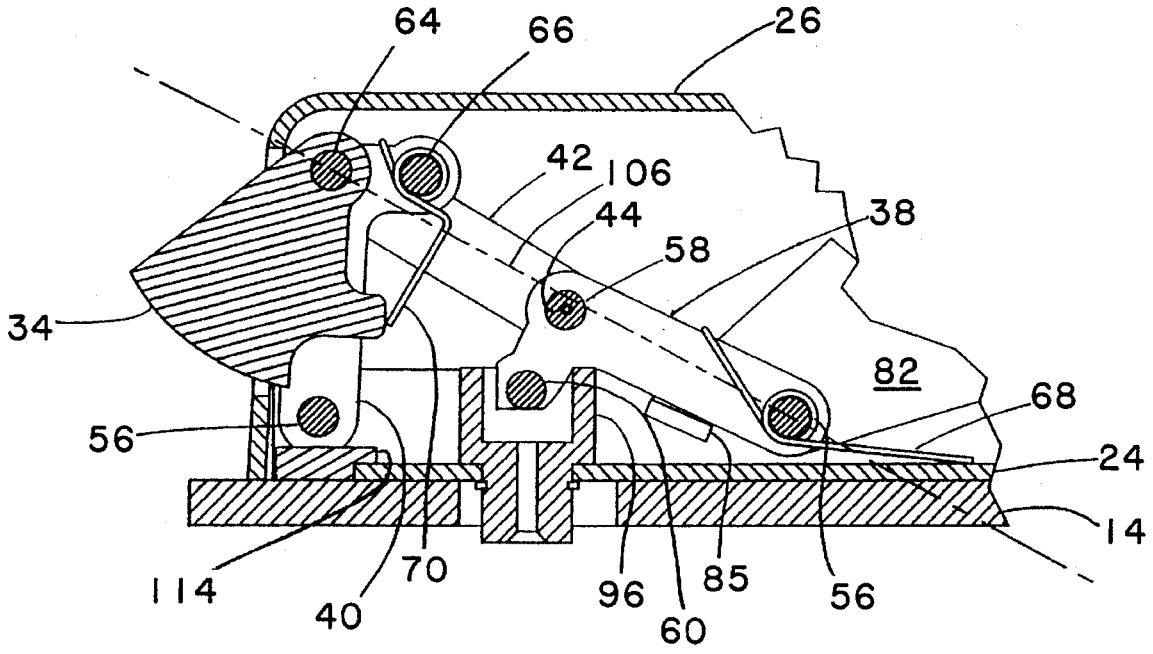
FIG. 4 is an enlarged, partial, side elevation view of the inside plate, bolt, operator subassembly and cover of the lock assembly of FIG. 1.
Figure 5A:
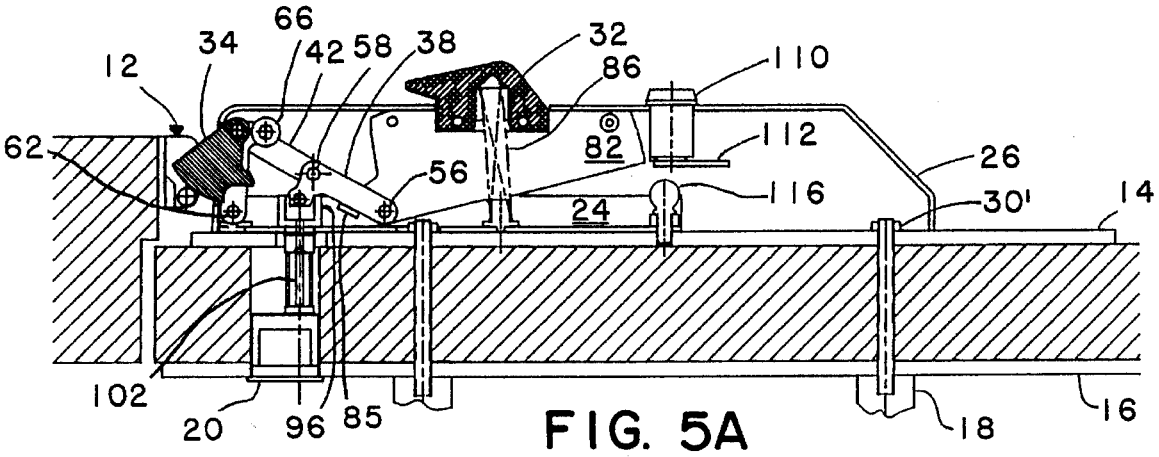
FIGS. 5A, 5B and 5C are partial, schematic side elevation views, with the side panel of the cover removed in the interest of clarity, of the apparatus depicted in FIG. 1, FIG. 5 showing enabling and operation of the lock assembly through use of the manual inside actuator.
Figure 6A:
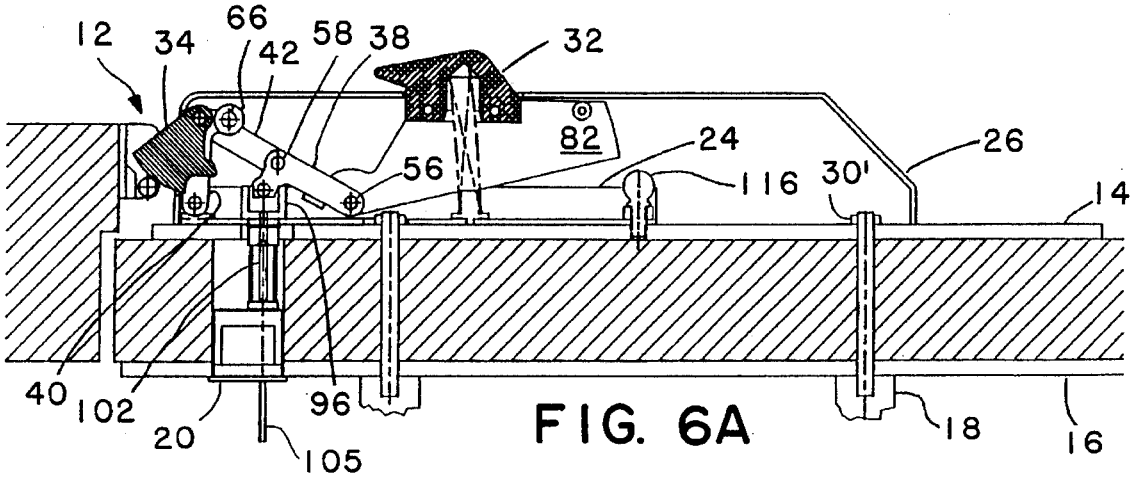
FIGS. 6A, 6B and 6C are views similar to FIG. 5 showing the exercise of control over the enablement and operation of the lock assembly of FIG. 1 by means of the outside lock cylinder.

The latch bolt 34 is rotatably mounted on axle 64 and is thus pivotally coupled to and moveable with pivot arm 40. Bolt 34 is moveable between a projected position, as shown in FIGS. 4, 5A and 6A for example, and retracted positions. When in the projected position, bolt 34 may engage the strike 12 to automatically latch and lock the door in the closed state. A latch spring 70 is mounted on axle 66 and resiliently biases bolt 34 in the bolt projected direction. Spring 70 extends between axle 66 and a surface 72 provided on the side of bolt 34 which faces the hinge side of the door, i.e., away from the strike.

The push pad 32, which is a second control means for enabling the retraction of the bolt, cooperates with the pivot arm assembly by means of a pair of parallel lever arms 82. The contact between lever arms 82 and the first pivot arm 38, in the disclosed embodiment, is established at a point intermediate the first end 52 of pivot arm 38 and the pivot axis 44. Lever arms 82 are mounted for pivotal motion about axis 84, i.e., the arms 82 are pivotally supported on axle 56. The portions of arms 82 disposed at opposite sides of axis 84 are angularly related as shown. The arms 82, at first ends thereof, have laterally projecting feet 85. The feet 85 are shaped and positioned to engage, and lift away from bracket 24, the pivot arm 38. A spring 86, having one end engaged by a spring locator 87 mounted on the bracket 24 and the other end disposed in a blind hole 88 in the push pad 32, biases the push pad 32 outwardly with respect to bracket 24. Since the push pad 32 is affixed to lever arms 82, the feet 85 are spring biased away from the first pivot arm 38. The second ends of arms 82 are interconnected by a spacer 89.

As discussed above, all of the components of the operator subassembly are mounted on elongated, channel-shaped bracket 24. Bracket 24 is removably affixed to the inside plate 14 at a first end by a tow plate 114, i.e., plate 114 has a bracket engaging lip portion. The other end of bracket 24 is affixed to plate 14 by a thumb screw 116 (FIGS. 5–7). This mounting arrangement facilitates removal of the operator subassembly and bolt from the door for cleaning. The cover 26 is mounted on the inside plate 14 by four thumb screws 142 which may easily be removed to gain access to the operator subassembly.

As shown in FIGS. 2, 3 and 4, a rotatable cam 96 is received in an aperture 100 in the inside plate 14. Cam 96 is preferably comprised of a material having a relatively low coefficient of friction. The rotatable plug 94 of lock 20 is coupled to the cam 96 by tailpiece 102. The plastic tube 104 is preferrably disposed around the tailpiece 102 to insure that the tailpiece may be rotated by the key 105 in the event of ice build-up within the small diameter hole bored through the door to accomodate the tailpiece. The axle 60 of the pivot arm assembly is biased into contact with cam 96 by the link springs 68 and thus functions as a cam follower. Rotation of tailpiece 102, accordingly, causes the axle 60 to move up and down a ramped face of cam 96 whereby the axle 58, and thus pivot axis 44, may be selectively positioned above or below a plane 106 (See FIG. 4) which is defined by the axes 44, 46 and 84 when aligned. With these axes in an aligned state, the linkage will be rigid, i.e., a force applied to the end 50 of arm 42 will be coupled to fixed position axle 56 via arm 38, and the linkage can not collapse allowing axle 46 and the bolt to move.

The disclosed embodiment of the present invention is normally locked. Accordingly, access to the interior of the compartment via a door on which the lock assembly 10 is installed normally requires that the lock cylinder be operated using a proper key. The key operation will be described below in the discussion of FIG. 6.

FIG. 5 depicts operation of the disclosed embodiment of the invention from the inside of the refrigerated compartment using the push pad 32. With reference to FIGS. 4 and 5A, when the door is closed and thus locked, the axis of axle 58, i.e., axis 44, is positioned slightly below, i.e., to the inside, of plane 106. This positioning of axis 44 results from springs 68 biasing arm 38 in the counter-clockwise direction as the apparatus is shown in FIG. 4. This spring biasing holds the axle 60, at the end of the "dog-leg" portion of arm 38, against cam 96. The position of axis 44 as shown in FIGS. 4 and 5A is the under-center, i.e., the deadlocked, condition of the pivot arm assembly defined collapsible linkage. Pushing the door from the inside or exerting a pull on handle 18, as a result of the contact of bolt 34 with strike 12, imposes a force on the bolt 34. Because of the shape of the bolt 34 and its cooperation with the stationary strike, the force applied to the bolt is translated into a force applied to the movable pivot axis of pivot arm 40 in a direction which is generally away from the door and inwardly with respect to cover 26. This force is transmitted by pivot arm 40 and pivot arm 42 to the movable pivot axis 44 of pivot arm 38, i.e., to the axle 58. Because of the under-center condition of the linkage defined by the serially connected pivot arms 38, 40 and 42, and specifically because pivot axis 44 is inside plane 106 as clearly shown in FIG. 4, the pivot arm assembly defined linkage cannot collapse. Restated, the force appled to axle 58 will be delivered to the immobile cam 96 and to fixed axle 56. Accordingly, the bolt can not retract and disengage from the strike.

Figure 5B:
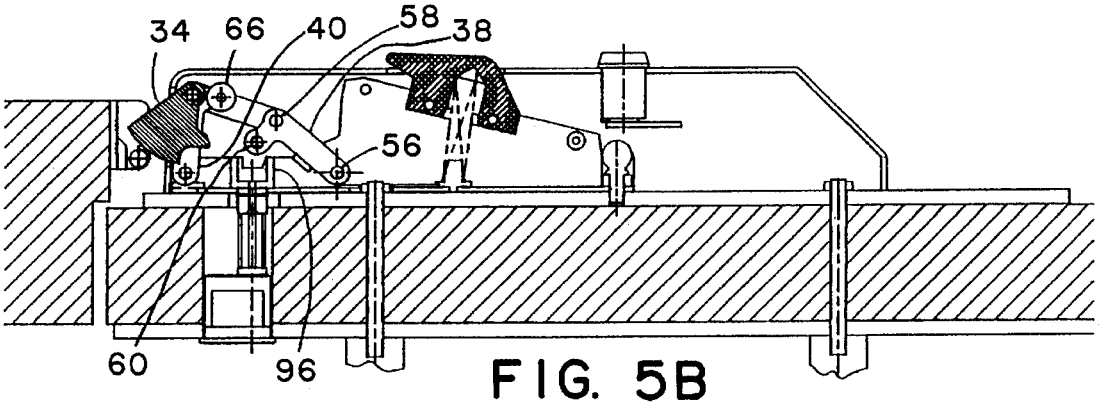
Figure 5C:
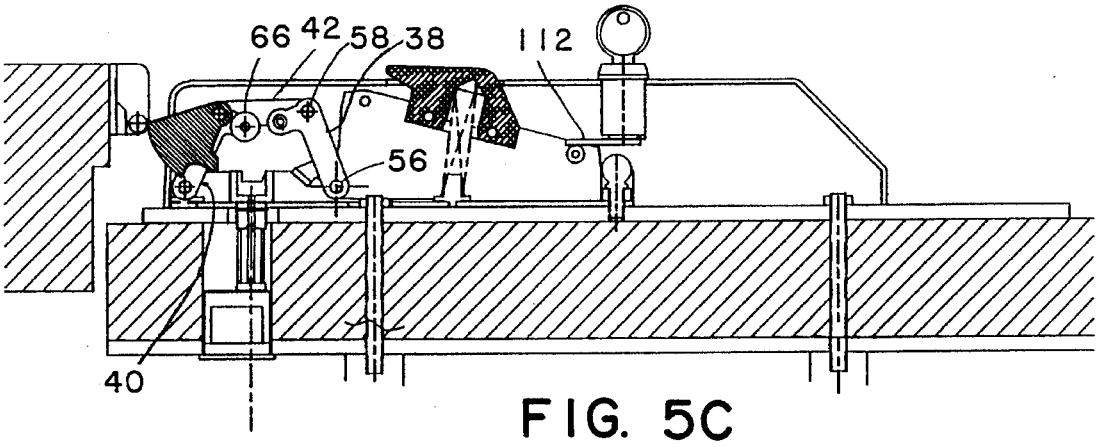

As shown in FIGS. 5B and 5C, pushing the push pad 32 imparts movement to feet 85 and thus movement to pivot arm 38. This movement of arm 38 lifts the axle 60 off the face of cam 96 and pivot axis 44 is simultaneously raised a short distance to the above-center side of plane 106. The operator subassembly is thus placed in the FIG. 5B enabled state. Restated, the lever arm feet 85 engage the first pivot arm 38 intermediate the axles 56 and 58 causing the axle 58 to move away from the inside plate 14. When pivot axis 44 reaches a position where it is outside of the plane 106, as shown in FIG. 5B, the pivot arm assembly defined linkage will be in an over-center collapsible state. Continued pushing of the push pad 32 imposes a force against the inside plate 14 and thus the freezer door. The force on the door, in turn, imposes a force on the bolt 34 as discussed above. This force is transmitted by the second pivot arm 40 to the third pivot arm 42. The third pivot arm will now, because of the repositioning of axis 44, direct a significant portion of the applied force in a generally lateral direction. The first pivot arm movable pivot axis 44, i.e., axle 58, is thus permitted to move away from the strike 12, as shown in FIG. 5C, allowing the bolt 34 to disengage from the strike 12 as the pivot arm assembly defined linkage "collapses" to the configuration shown in FIG. 5C.

Figure 6B:
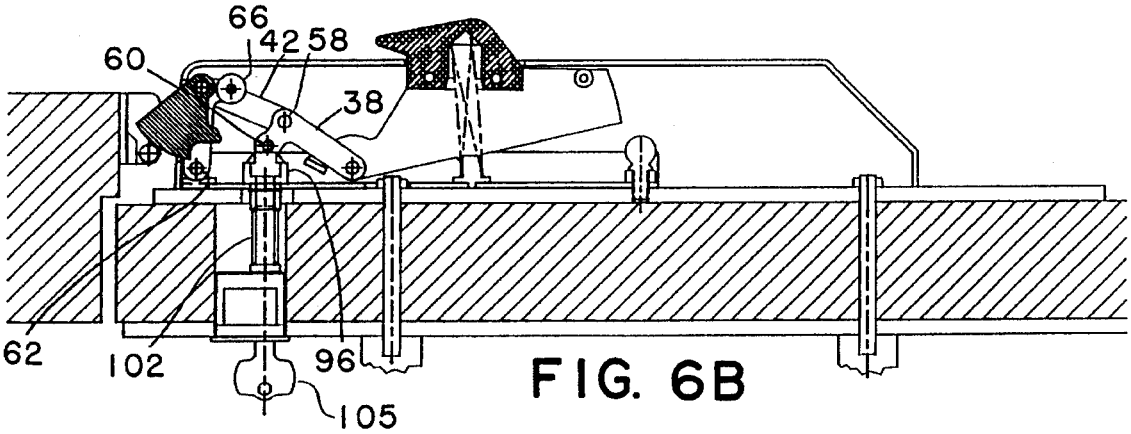
Figure 6C:
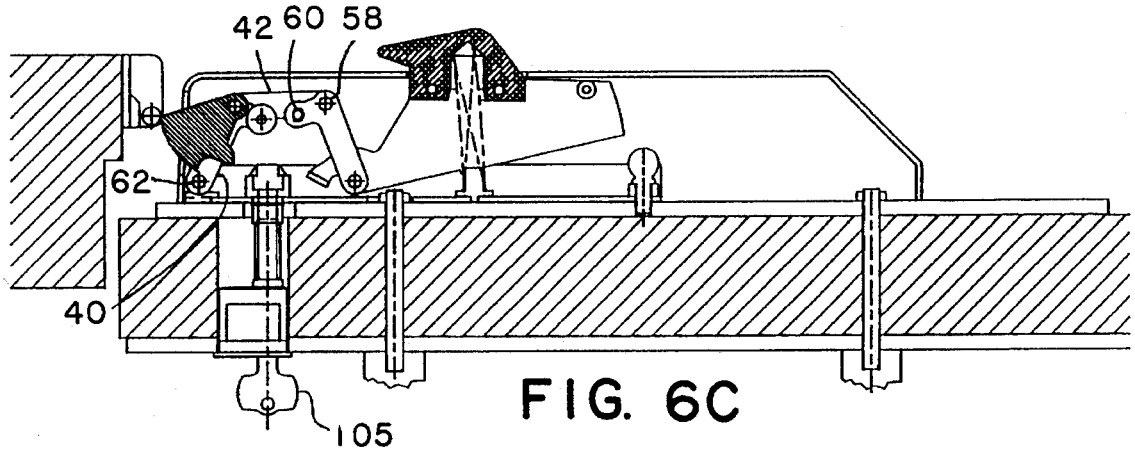

As shown in FIGS. 6A, 6B and 6C, rotating the cam 96 selectively positions the first pivot arm second end, i.e., the axle 60, on either a cam face high portion or a low portion. The axle 60 is normally held on a cam low portion by the biasing action of link springs 68 and, accordingly, the first pivot arm movable pivot axis 44 is inside the plane 106. In this condition, the collapsible linkage is deadlocked and the door is locked (FIG. 6A). When the axle 60 is placed on a high portion of cam 96 by employing the key to rotate the plug of the cylinder lock 20, the axis 44 is moved outside the plane 106 (see FIG. 6B) and the operator subassembly is in an enabled state. When the operator subassembly is in the enabled state, the door may be pulled open by means of handle 18 with the pivot arm assembly defined linkage collapsing as a result of force applied to bolt 34 by strike 12 as shown in FIG. 6C.

It should be noted that, in the preferred embodiment, the key 105 may be removed from the lock 20 only in the locked condition. Thus, the normal condition of the assembly will be the locked state of FIGS. 4, 5A and 6A, i.e., the key custodian will normally unlock the assembly only when necessary to afford temporary access.

The forces provided by the link springs 68 and latch spring 70, acting through the collapsible linkage and rotatable cam, will try to return the lock assembly to the locked condition with the axis 44 in the below-center position if the key is released or pressure removed from the push pad. Accordingly, a hold-back mechanism may be provided. Referring to FIG. 5, a hold-back mechanism comprising a second key operated lock 110, or alternatively a manually operated latch actuator, may be received in an aperture in the cover 26. The lock 110, when employed, or manual hold-back will have a swing arm 112. When the first ends of lever arms 82 are in the unlocked position, i.e., the touch pad depressed position of FIG. 5B, the arm 112 may be rotated to engage the upper surface of an arm 82 as shown in FIG. 5C. Such engagement prevents the lever arm feet 85 from moving away from pivot arm 38 under the influence of spring 86 and thus maintains the assembly in the unlocked condition where a relatively light pull or push on the door will cause it to open.

Figure 7A:
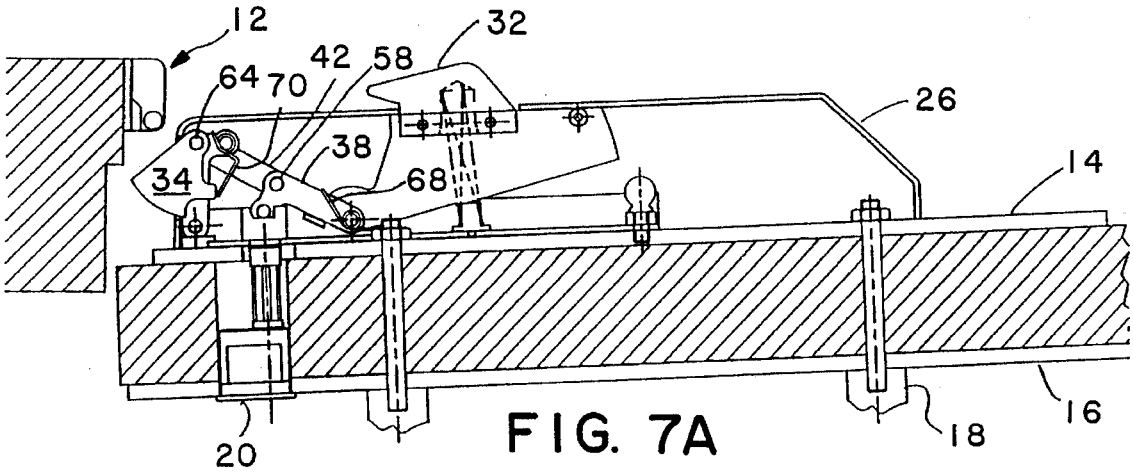
FIGS. 7A, 7B and 7C are views similar to FIGS. 5 and 6 which depict the action of the lock assembly upon closing of the door upon which it is mounted.
Figure 7B:
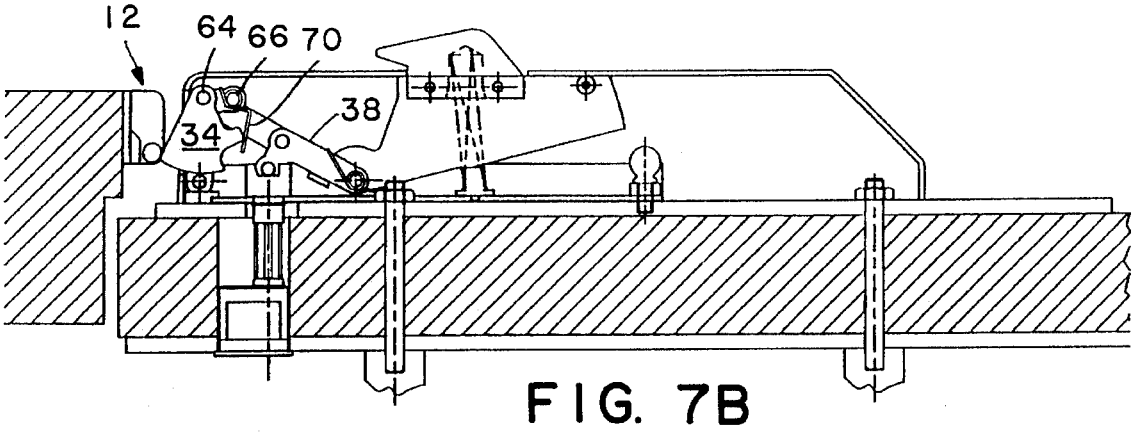
Figure 7C:
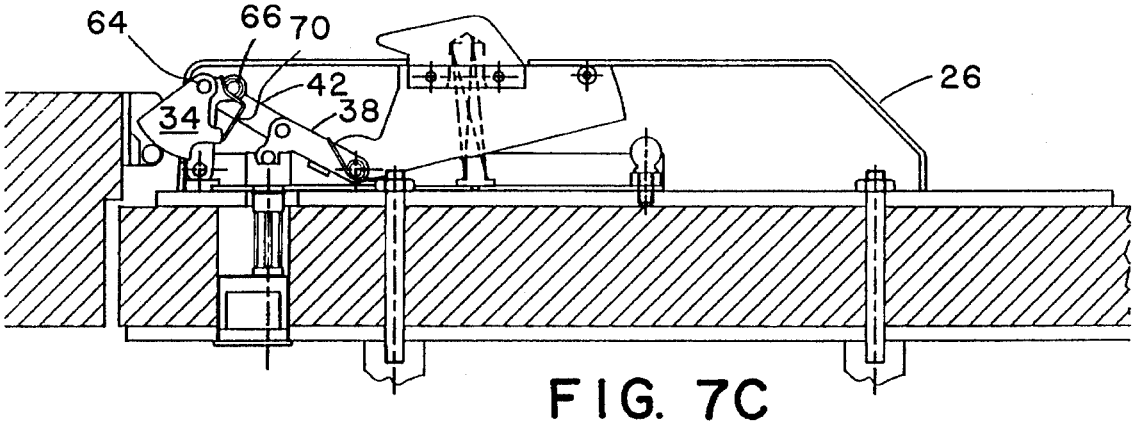

As shown in FIGS. 7A–7C, during door closing, contact between the "back" of bolt 34 and strike 12 will, in the conventional manner, cause the bolt to rotate about axle 64 thus allowing the bolt to pass the strike regardless of the condition of the collapsed linkage.

While preferred embodiments have been shown or described, various modifications and substitutions may be made thereto without departing from the spirit and scope of the invention. Accordingly, it is to be understood that the present invention has been described by way of illustration and not limitation.

What is claimed is:

1. A lock assembly for a door, a door with which the lock assembly is to be associated being supported from a frame and having first and second oppositely disposed surfaces, said lock assembly comprising:

handle means, said handle means being adapted for mounting on a first surface of a door;

key operated lock means, said lock means including a drive member movable in response to key operation;

strike means, said strike means being adapted for mounting on the frame of a door on which said handle means is mounted;

a bolt;

means pivotally supporting said bolt from the second surface of the door, said bolt supporting means positioning said bolt for cooperation with said strike means, said bolt supporting means including:

bolt enabling means, said enabling means comprising linkage means, said linkage means having a rigid state and a collapsible state, said bolt being pivotally mounted on said linkage means;

means for resiliently biasing said bolt in a first direction of rotation whereby said bolt will be extended and will engage said strike means to lock the door;

first control means coupled to said linkage means for selectively causing said linkage means to be configured in the rigid or collapsible state without imparting motion to said bolt whereby the application of force to said bolt when said first control means has caused said linkage means to be configured in the collapsible state will permit said linkage means to collapse and said bolt to retract and disengage said strike means;

second control means coupled to said linkage means for selectively causing said linkage means to be configured in the rigid or collapsible state without imparting motion to said bolt; and manual actuator means for causing operation of said second control means; and means for connecting said lock means drive member to said first control means whereby said lock means may control the state of said linkage means.

2. The apparatus of claim 1 wherein said bolt supporting means further comprising:

a mounting plate; and a support bracket removably affixed to said mounting plate, each of said bolt enabling means, resilient biasing means, control means and manual actuator means being mounted to said support bracket to thereby define a subassembly which includes said bolt, said subassembly being detachable from said mounting plate.

3. The apparatus of claim 1 wherein said handle means comprises:

a mounting plate, said lock means being attached to and extending through said mounting plate; and a handle rigidly affixed to said mounting plate whereby said handle means forms an integrated structure without moving parts.

4. The apparatus of claim 2 wherein said handle means comprises:

a second mounting plate, said lock means being attached to and extending through said second mounting plate; and a handle affixed to said second mounting plate whereby said handle means forms an integrated lock means support structure without moving parts.

5. The apparatus of claims 1 wherein said linkage means comprises:

at least three serially arranged pivot arms, the intermediately located of said arms being pivotally connected to the other two arms by axle means which define first and second pivot axes a first of said other arms also being pivotal about third axle means, the position of said third axle means being fixed, said third axle means defining a third pivot axis, said said second axis being located intermediate said first and third axes, said axes defining a plane when said linkage means is in the rigid state, said bolt being mounted for rotation about said first, pivot axis, said first and second control means imparting movement to said second axle means to selectively position said second pivot axis at a first or a second side of said plane, said linkage means being restrained against collapsing when said second pivot axis is located on the first side of the plane and being collapsible when said second pivot axis is located on the second side of said plane.

6. The apparatus of claim 5 wherein said first control means comprises:

movable cam means defining an adjustable stop; and means coupling said second axle means to said cam means whereby the position of said second pivot axis will be determined by said cam means, force applied to said bolt being transmitted to said cam means and said fixed third axle means when said second pivot axis is positioned on said first side of said plane whereby said second axle means will be immobilized and said linkage means will therefore be rigidized to prevent said bolt from moving, force applied to said bolt when said second pivot axis is on said second side of said plane imparting movement to said second axle means and causing said collapse of said linkage means and retraction of said bolt from contact with said strike means.

7. The apparatus of claim 6 wherein said bolt enabling means further comprises:

spring means for biasing said linkage means toward the rigid state, said spring means acting on said linkage means to urge said second axle means in a direction which causes said second axis to be on said first side of said plane.

8. The apparatus of claim 7 wherein said drive member is rotatable and said cam means comprises:

a rotatable cam; and wherein said means for coupling said second axle means to said cam means comprises:

an extension of one of said arms, said extension projecting from said second pivot axis toward said cam means; and cam follower means coupling said extension to said cam.

9. The apparatus of claim 7 wherein said second control means comprises:

lever means interconnecting said manual actuator means and said linkage means, said lever means engaging said linkage means intermediate said second and third axle means, said lever means moving said second axis from said first side of said plane to said second side of said plane in response to operation of said manual actuator means.

10. The apparatus of claim 8 wherein said second control means comprises:

lever means interconnecting said manual actuator means and said linkage means, said lever means engaging said linkage means intermediate said second and third axle means, said lever means moving said second pivot axis from said first side of said plane to said second side of said plane in response to operation of said manual actuator means.

11. The apparatus of claim 6 wherein said bolt supporting means further comprising:

a mounting plate; and a support bracket removably affixed to said mounting plate, each of said linkage means, cam means, coupling means, resilient biasing means, control means and manual actuator means being mounted to said support bracket to thereby define a subassembly which includes said bolt, said subassembly being detachable from said mounting plate.

12. The apparatus of claim 6 wherein said handle means comprises:

a mounting plate, said lock means being attached to and extending through said mounting plate; and a handle affixed to said mounting plate whereby said handle means forms an integrated lock means support structure without moving parts.

13. The apparatus of claim 11 wherein said handle means comprises:

a second mounting plate, said lock means being attached to and extending through said second mounting plate; and a handle affixed to said second mounting plate whereby said handle means forms an integrated lock means support structure without moving parts.

14. The apparatus of claim 9 wherein said bolt supporting means further comprising:

a mounting plate; and a support bracket removably affixed to said mounting plate, each of said linkage means, cam means, coupling means, spring means, resilient biasing means, control means and manual actuator means being mounted to said support bracket to thereby define a subassembly which includes said bolt, said subassembly being detachable from said mounting plate.

15. The apparatus of claim 14 wherein said handle means comprises:

a second mounting plate, said lock means being attached to and extending through said second mounting plate; and a handle affixed to said second mounting plate whereby said handle means forms an integrated lock means support structure without moving parts.

16. The apparatus of claim 10 wherein said bolt supporting means further comprising:

a mounting plate; and a support bracket removably affixed to said mounting plate, each of said linkage means, cam means, coupling means, spring means, resilient biasing means, control means, manual actuator means and lever means being mounted to said support bracket to thereby define a subassembly which includes said bolt, said subassembly being detachably from said mounting plate.

17. The apparatus of claim 16 wherein said handle means comprises:

a second mounting plate, said lock means being attached to and extending through said second mounting plate; and a handle affixed to said second mounting plate whereby said handle means forms an integrated lock means support structure without moving parts.

18. The apparatus of claim 17 wherein said strike means comprises:

a strike; and mounting plate means, said strike being affixed to said mounting plate means, said mounting plate means being adustable whereby the position of said strike relative to said bolt may be varied.

19. The apparatus of claim 18 wherein said key operated lock means comprises:

a cylinder lock, said cylinder lock having a replaceable key plug.

20. The apparatus of claim 1 wherein said bolt supporting means further comprises:

hold-back means, said hold-back means cooperating with said second control means to retain said linkage means in said collapsible state.

* * * * *

UNITED STATES PATENT AND TRADEMARK OFFICE

CERTIFICATE OF CORRECTION

PATENT NO. : 5,490,697

DATED : February 13, 1996

INVENTOR(S) : Walter E. Surko, Jr.

It is certified that error appears in the above-indentified patent and that said Letters Patent is hereby corrected as shown below:

Column 8, line 54, delete the comma after "first".

Column 9, line 33, after "second" insert --pivot--.

Column 10, line 37, "detachably" should read --detachable--.

Signed and Sealed this

Nineteenth Day of November, 1996

*Attest:*

*Attesting Officer*

BRUCE LEHMAN

*Commissioner of Patents and Trademarks*